US006695246B1

(12) United States Patent
Elliott et al.

(10) Patent No.: US 6,695,246 B1
(45) Date of Patent: Feb. 24, 2004

(54) MICROPROCESSOR CONTROLLED HANDS-FREE PAPER TOWEL DISPENSER

(75) Inventors: Adam T. Elliott, Lexington, KY (US); John I. Compton, Lexington, KY (US)

(73) Assignee: Bay West Paper Corporation, Harrodsburg, KY (US)

( * ) Notice: Subject to any disclaimer, the term of this patent is extended or adjusted under 35 U.S.C. 154(b) by 0 days.

(21) Appl. No.: 09/538,453

(22) Filed: Mar. 30, 2000

Related U.S. Application Data

(63) Continuation-in-part of application No. 09/085,289, filed on May 27, 1998, now Pat. No. 6,105,898, which is a continuation of application No. 08/603,051, filed on Feb. 16, 1996, now Pat. No. 5,772,291.

(51) Int. Cl.[7] ..... B65H 16/10
(52) U.S. Cl. ..... 242/564.1; 242/563; 242/563.2
(58) Field of Search ..... 242/563, 563.2, 242/564.1, 564.4, 596.3; 312/34.8, 34.22

(56) References Cited

U.S. PATENT DOCUMENTS

| | | | |
|---|---|---|---|
| 3,647,159 | A | 3/1972 | Bump |
| 3,730,409 | A | 5/1973 | Ratti |
| 3,971,607 | A | 7/1976 | Schnyder |
| 4,119,255 | A | 10/1978 | D'Angelo |
| 4,131,044 | A | 12/1978 | Cassia |
| 4,165,138 | A | 8/1979 | Hedge et al. |
| 4,195,787 | A | 4/1980 | Thomason |
| 4,398,310 | A | 8/1983 | Lienhard |
| 4,666,099 | A | 5/1987 | Hoffman et al. |
| 4,738,176 | A | 4/1988 | Cassia |
| 4,765,555 | A | 8/1988 | Gambino |
| 4,796,825 | A | 1/1989 | Hawkins |
| 4,826,262 | A | 5/1989 | Hartman et al. |
| 4,944,464 | A | 7/1990 | Zelenka |
| 4,960,248 | A | 10/1990 | Bauer et al. |
| 5,031,258 | A | 7/1991 | Shaw |
| 5,060,323 | A | 10/1991 | Shaw |
| 5,086,526 | A | 2/1992 | Van Marcke |
| 5,131,302 | A | 7/1992 | Watanabe |
| 5,217,035 | A | 6/1993 | Van Marcke |
| 5,294,192 | A | 3/1994 | Omdoll et al. |
| 5,452,832 | A | 9/1995 | Niada |
| 5,772,291 | A | 6/1998 | Byrd et al. |
| 6,056,261 | A | 5/2000 | Aparicio et al. |
| 6,069,354 | A | 5/2000 | Alfano et al. |
| 6,105,898 | A | 8/2000 | Byrd et al. |
| 6,293,486 | B1 | 9/2001 | Byrd et al. |
| 6,412,655 | B1 | 7/2002 | Stuetzel et al. |
| 6,412,679 | B2 | 7/2002 | Formon et al. |
| 6,419,136 | B2 | 7/2002 | Formon et al. |
| 2002/0088837 | A1 | 7/2002 | Formon et al. |

FOREIGN PATENT DOCUMENTS

| | | |
|---|---|---|
| FR | 2649603 | 1/1991 |
| WO | 90009755 | 9/1990 |
| WO | WO 99/58040 | 11/1999 |

OTHER PUBLICATIONS

LaCour Systems, Inc. *ille Toweltronic* brochure.

*Primary Examiner*—John Q. Nguyen
(74) *Attorney, Agent, or Firm*—Merchant & Gould P.C.

(57) ABSTRACT

A hands-free towel dispenser is provided which utilizes an active sensing system, preferably an infra-red system, for detecting when a dispense of toweling should occur. The control for the dispenser is designed for low power use, thereby allowing the dispenser to be battery powered. The dispenser can also be powered by a solar panel, either in addition to or in place of, the batteries. Thus, the dispenser can be used in all lighting conditions. In addition, the dispenser is microprocessor controlled, thereby reducing costs and adding flexibility and functionality.

12 Claims, 15 Drawing Sheets

MICROPROCESSOR CONTROLLED HANDS-FREE PAPER TOWEL DISPENSER

This application is a continuation-in-part of U.S. patent application Ser. No. 09/085,289, filed on May 27, 1998, U.S. Pat. No. 6,105,898; which is a continuation of U.S. patent application Ser. No. 08/603,051, filed on Feb. 16, 1996, now U.S. Pat. No. 5,772,291.

FIELD

The invention disclosed herein relates to towel dispensers and methods for dispensing towels. More particularly, the invention disclosed herein relates to electric "hands-free" towel dispensers and methods for dispensing towels without use of the hands.

BACKGROUND

Towel dispensers are known and are shown in U.S. Pat. Nos. 3,647,159, 4,131,044 and 4,165,138. For example, Bump, U.S. Pat. No. 3,647,159 shows a towel dispenser having an automatic towel length controlling means and roll support tensioning means. The towel dispenser disclosed generally comprises a shell, means within the shell for rotatably supporting a roll of paper toweling, a frictional power roller engaging a paper web from the roll, and means for limiting the length of individual paper towels withdrawn from the dispenser. The latter means includes a first gearlike member rotatable with the power roll, a second gearlike member rotatable in response to rotation of the first gearlike member, a finger carried by the second gearlike member, a strap mounted for linear movement on the dispenser between a first position and a second position, an abutment surface carried by the strap in a position intersecting the excursion path of the finger when the strap is in a first position, a limit abutment carried by the strap in a position intersecting the excursion path of the finger when the strap is in the second position, means temporarily holding the strap in the second position and means urging the strap toward the first position. The strap is moved toward the second position by contact of the finger with the abutment surface in response to rotation of the second gearlike member.

Electronic towel dispensers are also known. U.S. Pat. Nos. 3,730,409, 3,971,607, 4,738,176, 4,796,825 and 4,826,262 each disclose electronic towel dispensers. For example, in Ratti, U.S. Pat. No. 3,730,409, a dispenser comprises a cabinet having a supply roll of paper towel therein and an electric motor-driven dispensing roll frictionally engaging the towel web for advancing it through a dispensing opening past a movable cutter. The cutter is biased to a normal rest position and is movable to a severing position in response to the manual cutting action by a user. The dispenser further comprises a control circuit including a normally closed start switch and a normally open ready switch connected in a series between the motor and an associated power source. The normally open stop switch is in parallel with the ready switch. Program apparatus is coupled to the cutter, the motor and the control circuit and is responsive to movement of the cutter to its severing position for opening the start switch and closing the ready switch. Movement of the cutter back to its normal rest position recloses the start switch to energize the motor. The program apparatus is responsive to operation of the motor for sequentially closing the stop switch then reopening the ready switch and then reopening the stop switch to de-energize the motor.

Finally, "hands-free" systems for controlling the operation of washroom fixtures such as water faucets, soap dispensers and towel dispensers are known. Examples of such hands-free systems are disclosed in U.S. Pat. Nos. 4,796,825, 5,031,258, 5,060,323, 5,086,526, and 5,217,035. In Hawkins, U.S. Pat. No. 4,796,825, an electronic paper towel dispenser is shown which permits paper towels to be dispensed from a supply roll by placing a hand or other object in front of a sensor located on the front of the supply cabinet. Dispensing of the paper towels is stopped when the hand is removed or when normal room lighting is not available. The dispensing of towels is controlled by a touchless switch for energizing a motor means.

The problem with prior hands-free electronic dispensers is that they require a source of electricity such as AC current from a plug-in wall outlet to power the hands-free mechanism. This can be dangerous to a user, especially when the dispenser is near a sink or other source of water. Another problem is that many prior hands-free dispensers are complicated devices which are expensive to manufacture and difficult to maintain in working order. Still another problem is that prior hands-free dispensers continue to dispense paper so long as the user's hand remains in front of the sensor. Also, if a change in ambient light occurs, prior hands-free dispensers have to be manually reset to adjust to a new light reference.

Therefore, it would be advantageous to provide improved towel dispensers for automatically dispensing a length of towel in response to the movement of an object such as a user's hands. In this manner, a user can avoid contact with viruses or bacteria on the dispenser left by prior users' hands. It would be further advantageous to provide energy-efficient hands-free dispensers which utilize light energy. It would also be advantageous to provide hands-free dispensers which are simple in design, safe and easy to use. It would be even further advantageous to provide hands-free dispensers which are inexpensive to manufacture and free from problems such as inoperability due to jamming or changes in ambient light conditions.

SUMMARY

A hands-free towel dispenser is provided which utilizes an active sensing system, preferably an infra-red system, for detecting when a dispense of toweling should occur. The control for the dispenser is designed for low power use, thereby allowing the dispenser to be battery powered. The dispenser can also be powered by a solar panel, either in addition to or in place of, the batteries. Thus, the dispenser can be used in all lighting conditions.

In one aspect of the invention, as claimed, a hands-free towel dispenser is provided. The hands-free dispenser comprises a housing for containing at least one roll of towels, a sensor for detecting an object, a dispensing mechanism for dispensing a towel when the sensor detects the object, an electric power source for powering the dispensing mechanism, and control circuitry for controlling the dispensing mechanism, where the control circuitry includes a microprocessor.

In another aspect of the invention, as claimed, a hands-free towel dispenser is provided. The dispenser comprises a housing for containing at least one roll of towels, a sensor for detecting an object, a dispensing mechanism for dispensing a towel when the sensor detects the object, an electric power source powering the dispensing mechanism, and control circuitry for controlling the dispensing mechanism. In this version, the sensor comprises a source of infra-red light and a sensor for sensing infra-red light reflected by the object.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DESCRIPTION OF THE DRAWINGS

These and other features of the invention will now be described with reference to the drawings of preferred embodiments, which are intended to illustrate and not to limit the invention and in which.

DETAILED DESCRIPTION

As used throughout the specification, including the claims, the term "hands-free" means control of a dispensing mechanism without the need for use of hands.

In addition, as used throughout the specification, including the claims, the term "towel" refers generally to an absorbent paper or other suitable material used for wiping or drying.

Figure 1:
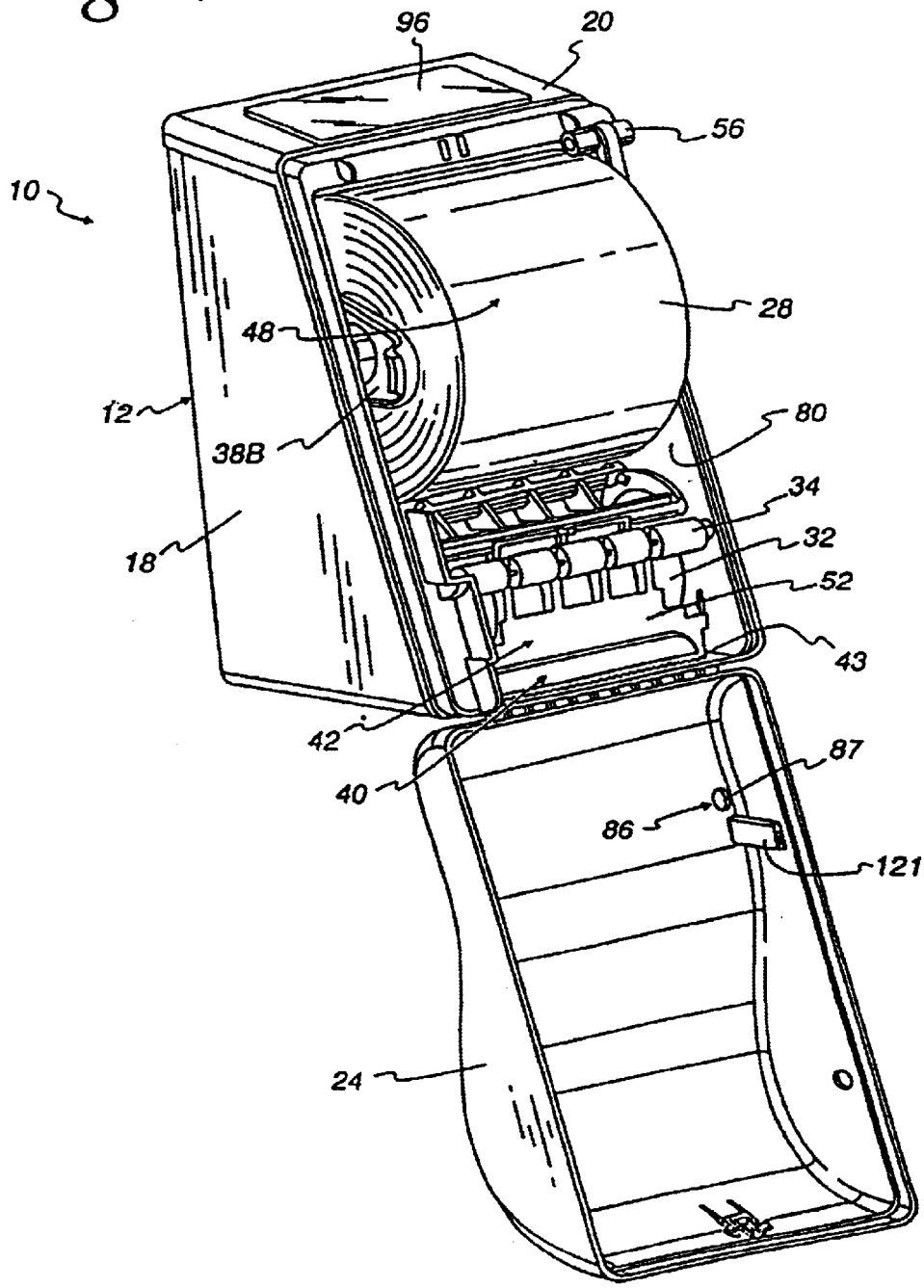
FIG. 1 is a perspective view of an embodiment of the towel dispenser of the invention.

As shown in FIG. 1, in a preferred embodiment of the invention, a hands-free towel dispenser 10 comprises a cabinet 12 comprising a back wall 14, two side walls 16, 18, a top wall 20, a bottom or base wall 22, and an openable and closeable front cover 24. The front cover 24 may be pivotally attached to the cabinet, for example, by hinge 26, for easy opening and closing of the cover 24 when a supply of towels such as main roll 28 is placed in the cabinet 12. The towel dispenser 10 may be mounted to a wall or other supporting member by any convenient means such as brackets, adhesives, nails, screws or anchors (not shown).

Figure 2:
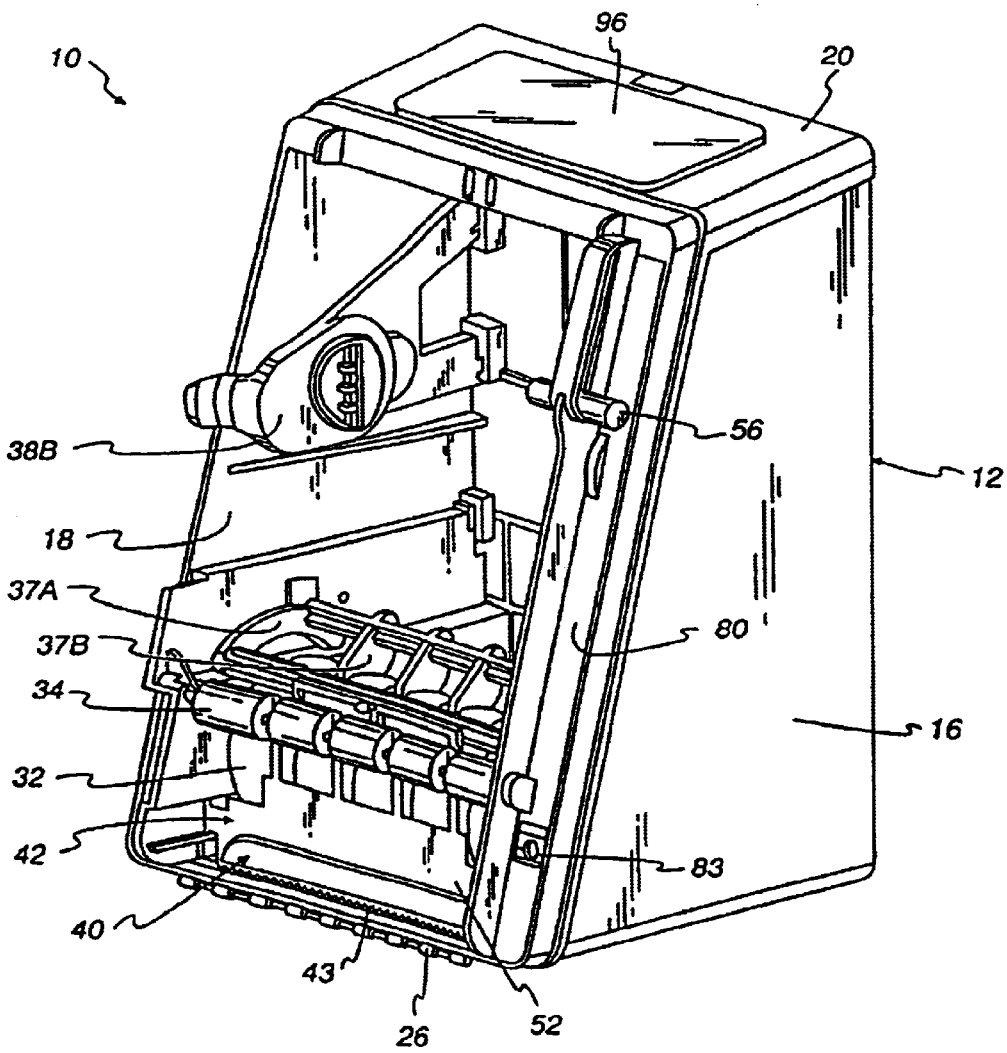
FIG. 2 is a perspective view of the towel dispenser of FIG. 1 with the towel roll removed.
Figure 3:
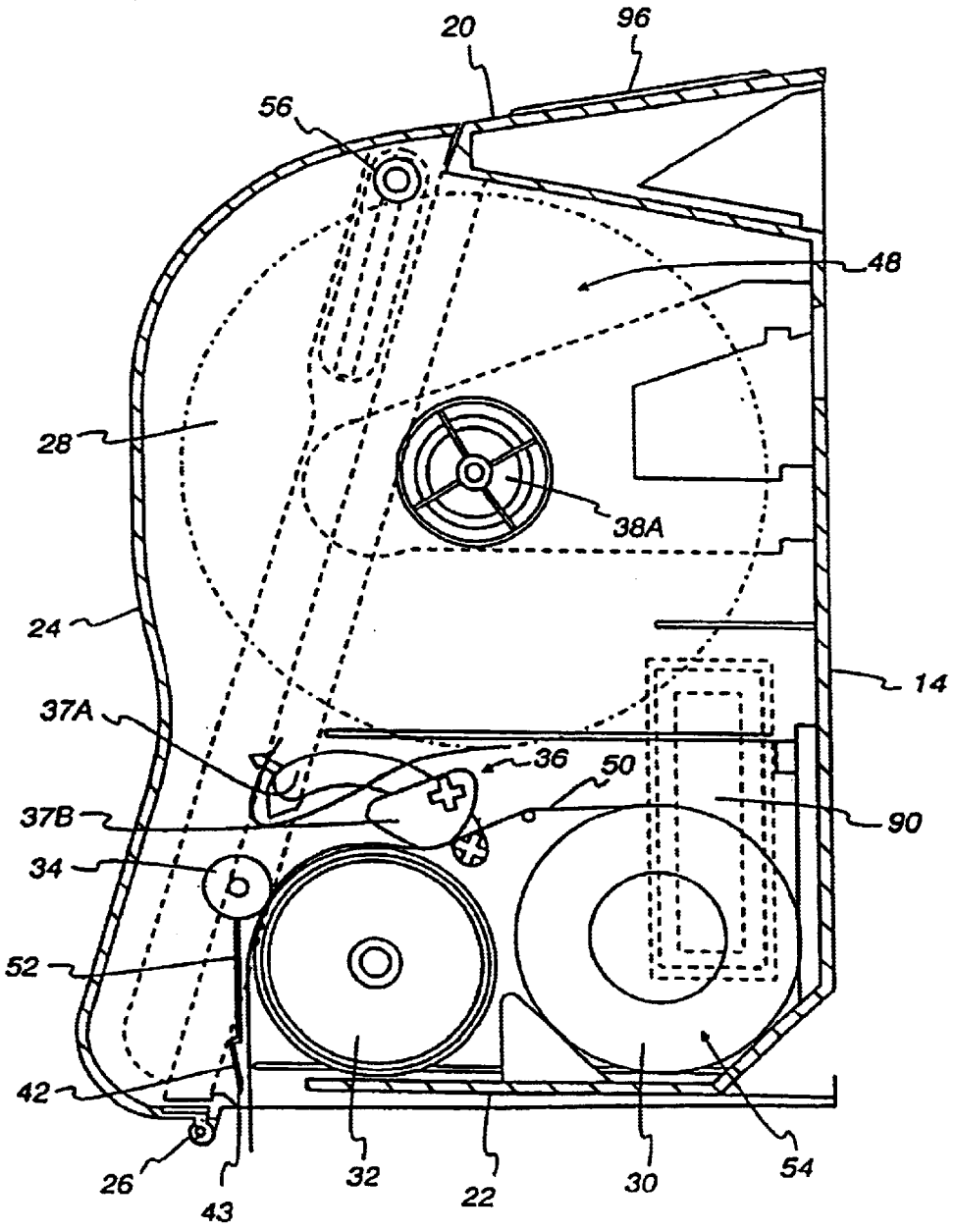
FIG. 3 is a sectional view of a side elevation of the towel dispenser of FIG. 2.
Figure 4:
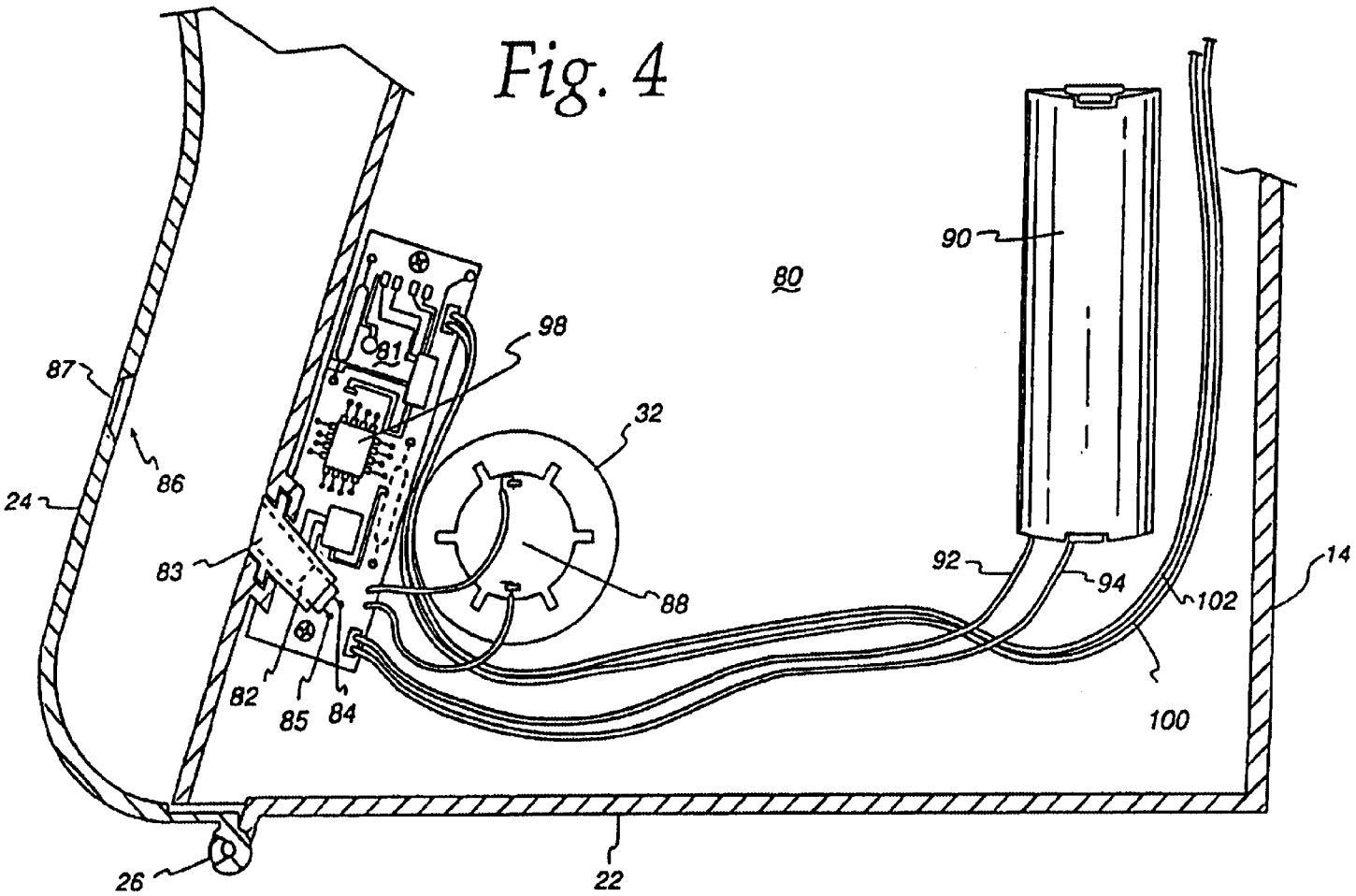
FIG. 4 is a board layout for a mechanical plate used in the dispenser of the invention.

As shown in more detail in FIGS. 2, 3 and 4, the hands-free dispenser 10 further comprises a dispensing mechanism for dispensing a length of towel to the outside of the dispenser 10. Such dispensing mechanism may comprise drive roller 32, pinch roller 34, transfer bar 36 and roll support cup 38*a* and roll support arm 38*b*. The dispensing mechanism enables dispensing of a predetermined length of towel to the outside of the towel dispenser 10 through slot 40, where the towel can be grasped by the user and torn off along a serrated edge 43 of a blade 42.

The dispensing mechanism operates to dispense towels either from a main roll 28 or a stub roll 30. The means for controlling dispensing of paper from the main roll 28 once the stub roll 30 has been depleted comprises a transfer bar 36, which is described in detail in U.S. Pat. No. 4,165,138, the disclosure of which is incorporated by reference herein.

As shown in FIGS. 1, 2 and 3, main roll 28 is first loaded into the cabinet 12 onto roll support cup 38*a* and roll support arm 38*b* located opposite each other on side walls 16, 18, respectively, and forming main roll station 48 (FIG. 1). A length of towel from main roll 28 is then threaded behind transfer bar 36 including a fork 37*a* and a cam 37*b*, and over drive roller 32 so that towel sheeting 50 will be pulled between the drive roller 32 and the pinch roller 34 in a generally downward motion when the drive roller 32 is rotated by operation of a motor 88 shown in FIG. 4. As the towel sheeting 50 is pulled downwardly, it is guided along a wall 52 of the serrated blade 42 and out slot 40.

The length of towel sheeting 50 dispensed from towel dispenser 10 can be set to any desired length. Preferably, the dispenser 10 releases about ten to twelve inches of towel sheeting 50 per dispensing cycle. The towel sheeting 50 is then removed by tearing the length of dispensed towel sheeting 50 at the serrated edge 43 of blade 42.

When the main roll 28 has been partially depleted, preferably to about a four-inch diameter as indicated by low paper indicator 56, the dispenser cover 24 is opened by an attendant, and the main roll 28 is moved down to a stub roll station 54. The main roll 28 then becomes stub roll 30 and enables a new main roll 28 to be loaded onto roll support cup 38*a* and roll support arm 38*b* in main roll station 48. When stub roll 30 is completely depleted the new main roll 28 begins feeding paper 50 between the drive roller 32 and pinch roller 34 out of the dispenser 10 when the motor 88 is activated.

When the low paper indicator 56 indicates that the new main roll 28 is low, the attendant opens cover 24, an empty core (not shown) of stub roll 30 is removed from the stub roll station 54 and discarded, and new main roll 28 is dropped into position into the stub roll station 54 where it then becomes stub roll 30 and continues feeding. A main roll 28 is then positioned on the roll support cup 38*a* and roll support arm 38*b*. The basic transfer mechanism for continuously feeding towels from a stub roll until completely used and then automatic transfer to a main roll is described in detail in U.S. Pat. No. 4,165,138.

Hands-free operation of the dispenser 10 is effected when a person places an object such as their hands in front of a photo sensor 82 shown in FIG. 4. The photo sensor 82 activates the motor 88 to dispense a predetermined length of towel sheeting 50. The dispenser 10 has electric circuitry which, as will be described below with reference to FIGS. 4–8, ensures safe, efficient and reliable operation of the dispenser 10.

Referring now to FIG. 4, a cutaway view of a portion of the dispenser 10 is shown. In FIG. 4, a circuit board 81 is mounted to a mechanical plate 80 of the dispenser 10. Note that the circuit board is mounted between the mechanical plate 80 and the wall 16 of the cabinet 12. The photo sensor 82 is seated within a mounting tube 83 and is coupled to the circuit board 81 by leads or wires 84, 85. As will be described below with reference to FIG. 5, the photo sensor 82 reacts to changes in light intensity. Light passes from a room, through an opening 86 in the movable front cover 24 of the dispenser 10, to the photo sensor 82. A clear plastic lens 87 is fitted into the opening 86. The lens 87 prevents debris from clogging or blocking the opening 86 which might prevent light from reaching the sensor 82. The lens 87 also prevents debris from falling into the dispenser 10 which might cause the dispenser 10 to malfunction.

Also shown in FIG. 4 is the motor 88 which is attached to the drive roller 32. The motor 88, including a gearbox (not shown), are available from Skil Corporation in Chicago, Ill. The motor 88 is placed partially within the drive roller 32 and is powered by a rechargeable battery 90, also available from Skil Corporation. The battery 90 is coupled to the motor 88 via the circuit board 81 by wires or leads 92, 94 which are connected or soldered to the circuit board 81.

A solar panel 96, is located on the top 20 of the dispenser 10 as shown in FIG. 1. The solar panel 96 shown, which comprises an array of one or more photovoltaic cells, is made by Solarex Corporation in Frederick, Md. The solar panel 96 is coupled to the battery 90 and control circuitry 98 via the circuit board 81 by wires or leads 100, 102 which are connected or soldered to the circuit board 81 also.

The solar panel 96 provides power to control circuitry 98 for controlling the dispensing mechanism of the dispenser 10. In a preferred embodiment, the solar panel 96 provides power to control circuitry 98 (FIG. 5) which will manage motion sensing, rotation control, safety features, and recharging of the battery 90. In a second embodiment, the solar panel 96 provides power to the control circuitry 98 which will manage motion sensing, rotation control and safety features, but the battery 90 will be replaced at desired intervals and will not be recharged by the control circuitry 98. When the solar panel 96 is not exposed to light, the solar panel 96 does not supply power to the control circuitry 98 and the motor 88 cannot be turned on. The solar panel 96 functions as an on-off switch for the dispenser 10 and thereby prevents the battery 90 from becoming unnecessarily discharged when the lights are off. If the control circuitry 98 is not powered by the solar panel 96, the motor 88 cannot be turned on.

Figure 5:
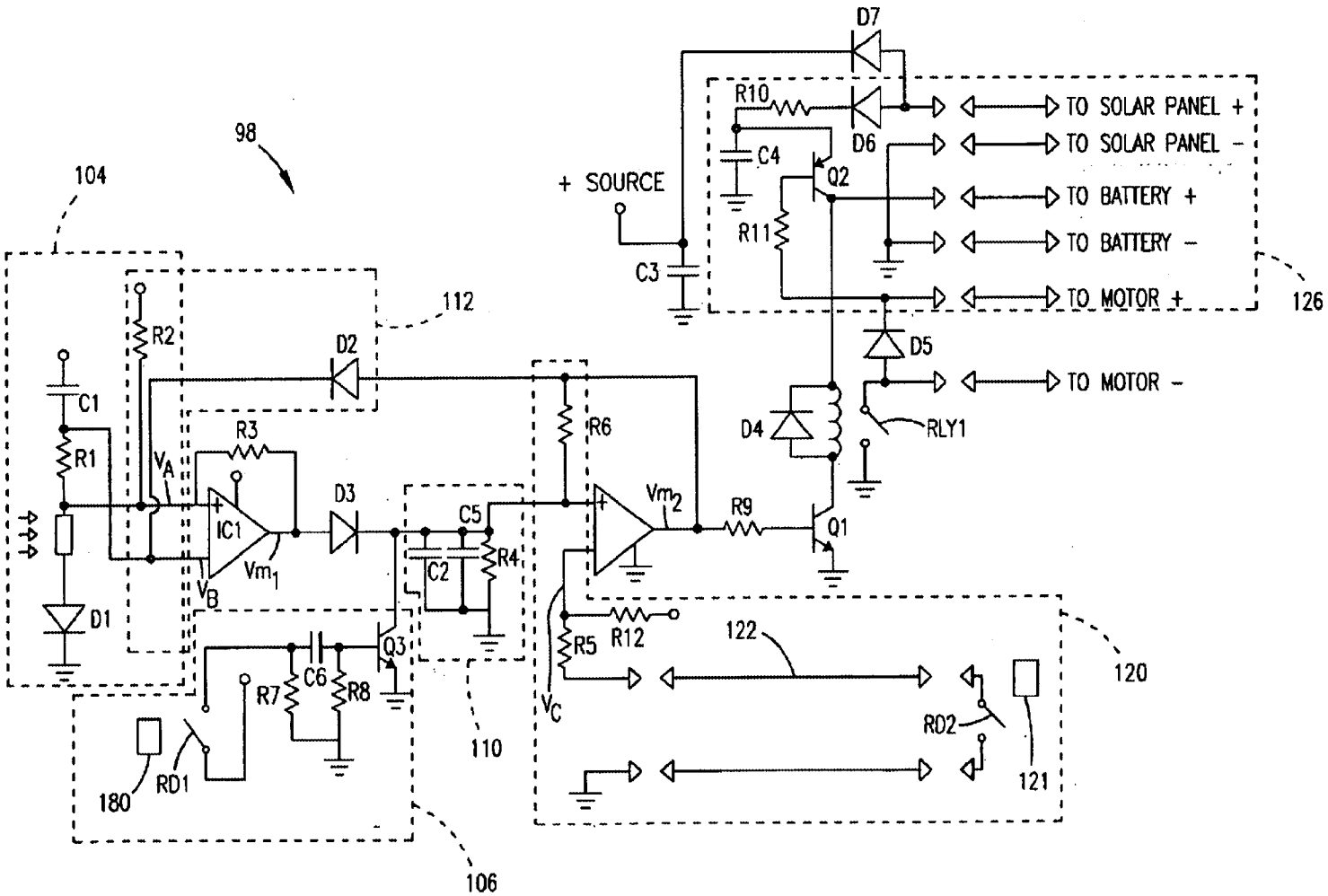
FIG. 5 is a schematic diagram for the electric circuit of the invention.

Referring now to FIG. 5, a schematic diagram of the control circuitry 98 is shown. The control circuitry 98 controls the "hands-free" operation of the dispenser 10. More specifically, the control circuitry 98 controls and/or performs the following functions: (1) sensing when an object such as a person's hand is in front of the photo sensor 82 and turning the motor 88 on; (2) sensing when the proper length of towel sheeting 50 has been dispensed and then turning the motor 88 off; (3) sensing when towel sheeting 50 has jammed inside of the dispenser 10 and turning the motor 88 off; (4) sensing when the front cover 24 of the dispenser 10 is open and preventing operation of the motor 88; (5) creating a short delay, preferably about two seconds, between dispensing cycles; and (6) charging of the battery 90 by the array of one or more photovoltaic cells 96.

The values of the components shown in the schematic diagram of FIG. 5 are as listed below:

| RESISTORS |
|---|
| R1 = $1 \times 10^6$ ohm |
| R2 = $520 \times 10^3$ ohm |
| R3 = $1 \times 10^6$ ohm |
| R4 = $3 \times 10^6$ ohm |
| R5 = $3.3 \times 10^6$ ohm |
| R6 = $10 \times 10^6$ ohm |
| R7 = $1 \times 10^6$ ohm |
| R8 = $20 \times 10^3$ ohm |
| R9 = 680 ohm |
| R10 = 8 ohm |
| R11 = $1 \times 10$ ohm |
| R12 = $1 \times 10^6$ ohm |

| CAPACITORS |
|---|
| C1 = $1 \times 10^{-6}$ Farad |
| C2 = $1 \times 10^{-6}$ Farad |
| C3 = $104 \times 10^{-6}$ Farad |
| C4 = $104 \times 10^{-6}$ Farad |
| C5 = $1 \times 10^{-6}$ Farad |
| C6 = $1 \times 10^{-6}$ Farad |

Other Components

All diodes are part nos. IN4148 or IN914 from Diodes, Inc.

Operational Amplifiers IC1A and IC1B are on circuit board ICL7621DCPA from Maxim.

Transistors Q1 and Q2 are part no. 2N3904 from National.

Transistor Q3 is part no. 2N3906 from National.

The solar panel is part nos. NSL-4532 or NSL-7142 from Solarex.

Reed switches RD1 and RD2 are part no. MINS1525-052500 from CP-CLAIRE.

Relay RLY1 is part no. TF2E-3V from AROMAT.

The photo sensor 82 shown is a Cadmium Sulfide ("CDS") motion detector manufactured by Silonex Corporation located in Plattsburg, N.Y. The photo sensor 82 is a variable resistance resistor. The resistance of the photo sensor 82 changes depending on the amount of light to which the photo sensor 82 is exposed. If the amount of light on the photo sensor 82 is high, the photo sensor's resistance becomes relatively low. If the amount of light on the photo sensor 82 is low, the photo sensor's resistance becomes relatively high.

In ambient light, the photo sensor 82 has a certain resistance which causes voltage $V_A$ to be less than a reference voltage $V_B$. Voltage $V_A$ and reference voltage $V_B$ are the positive and negative inputs, respectively, of operational amplifier IC1A. When voltage $V_A$ is less than reference voltage $V_B$, the operational amplifier IC1A output voltage $V_{M1}$, goes to negative, i.e., $V_{M1}$ is at zero voltage. When voltage $V_{M1}$ is at zero voltage, the motor 88 will not operate.

Note that the reference voltage $V_B$ is determined by and adjusts according to the ambient light level in a room. Therefore, the reference voltage $V_B$ is not preset to any particular light level. A reference voltage circuit 104 sets the reference voltage $V_B$ according to the ambient light level of a room. Because the reference voltage circuit 104 sets the reference voltage $V_B$ according to the ambient light level in a room, no adjustments need to made to the dispenser 10 based on how high or low the ambient light level is for a particular room. Furthermore, the combination of the photo sensor 82 and the reference voltage circuitry 104 permit the photo sensor 82 to trigger the dispenser 10 when a person's hand comes within approximately 10–12 inches from the sensor 82.

The reference voltage circuit 104 includes resistors R2 and R3 and capacitor C1. Resistors R2 and R3 are connected to the positive terminal, SOLAR PANEL+, of the solar panel 96 which provides a voltage $B_+$ when the solar panel 96 is exposed to light. In ambient light, voltage $V_A$ is approximately $0.5(B_+)$.

When a person places an obtrusion such as their hand within a predetermined distance of the photo sensor 82, preferably within 10–12 inches, the amount of light reaching the photo sensor 82 is decreased sufficiently to cause the photo sensor's resistance to increase to a level where voltage $V_A$ becomes greater than voltage $V_B$ and thereby causes the output $V_{M1}$ of operational amplifier IC1A to be a positive voltage.

The operational amplifier IC1A output voltage $V_{M1}$ is passed through diode D1 and is coupled to the positive input of operational amplifier IC1B. Reference voltage $V_C$ is provided between resistors R5 and R6 and is the negative input of operational amplifier IC1B. If voltage $V_{M1}$ is greater than reference voltage $V_C$, then the output of the operational amplifier IC1B, $V_{M2}$, is at a positive voltage. When the output voltage $V_{M2}$ is at positive voltage, n-p-n transistor Q1 is closed, thereby causing a current to flow through coil CL1 which in turn closes coil relay RLY1. When RLY1 is closed, the motor 88 runs because the motor's positive terminal, MOTOR+, is connected to the battery's positive terminal, BATTERY+.

In order to stop the motor 88 from turning after a predetermined amount of towel sheeting 50 has been dispensed, a roller sensing circuit 106 is provided. The roller sensing circuit 106 includes a magnet, 108, an n-p-n transistor Q3, a capacitor C6, resistors R7 and R8 and a reed switch RD1. The magnet 108 is mounted on drive roller 32. The magnet 108 activates or closes the reed switch RD1 when the magnet 108 is aligned with the reed switch RD1. When the reed switch RD1 is closed, a one time voltage drop is made across capacitor C6. The voltage drop across capacitor C6 turns on transistor Q3 which causes voltage $V_{M1}$ to drop to less than reference voltage $V_C$ and therefore produces a negative output or zero voltage output $V_{M1}$ from operational amplifier IC1B and stops the motor 88 from operating. By changing the radius of the drive roller 32, the length of paper 50 that is dispensed can be varied.

The time it takes for the motor 88 to turn the drive roller 32 one full turn, i.e., the time it takes for the magnet 108 to become aligned with reed switch RD1, is approximately 0.47 seconds. When the drive roller 32 has made one full turn, the predetermined amount of towel sheeting 50 has been dispensed and the magnet 108 is aligned again with the reed sensor RD1 to stop operation of the motor 88, as described above. Preferably, the motor 88 will power an approximately 3–4 inch diameter roller for one revolution, sufficient to dispense approximately 10–12 inches of paper towel 50. If the reed sensor RD1 is not activated within 1.0 second, e.g., if a paper jam occurs, a safety timer circuit 110 turns the motor 88 off.

The safety timer circuit 110 includes capacitor C2 and resistor R4. If the reed switch RD1 does not sense the magnet 108 within 1.0 second, the safety timer circuit 110 causes voltage $V_{M1}$ to drop below reference voltage $V_C$ and thereby causes output voltage $V_{M2}$ to be at zero volts and turns the motor 88 off.

When the front cover 24 is open, e.g., to add towel sheeting 50 in the dispenser 10, the motor 88 is prevented from operating by a door safety circuit 120. The door safety circuit 120 includes resistors R5 and R6, a reed switch RD2 and a magnet 121. One lead 122 of the reed witch RD2 is attached to resistor R5 and the other lead 124 is attached to ground G2. Reference voltage $V_C$ is created between resistors R5 and R6. When the front cover 24 is open, the reed witch RD2 is open and causes voltage $V_C$ to be higher than voltage $V_{M1}$ and therefore causes the output voltage, $V_{M2}$, of operational amplifier IC1B to be at zero voltage. Note that voltage $V_{M2}$ is never higher than voltage $B_+$.

When the front cover 24 is closed, the magnet 121 causes the reed switch RD2 to close and allows reference voltage $V_C$ to be less than voltage $V_{M1}$, which in turn causes the output voltage $V_{M2}$ of operational amplifier IC1B to be at positive voltage and turns the motor 88 on.

In ambient room light, the solar panel 96 generates enough current to power the control circuitry 98. In the preferred embodiment (shown in FIG. 5), the solar panel 96 generates enough current to also charge the battery 90. In this preferred embodiment, a positive lead, SOLAR PANEL+, of the solar panel 96, is connected to battery charging circuitry 126.

The battery charging circuitry 126 includes a diode D5, resistors R11 and R16, a capacitor C4 and a p-n-p transistor Q2. The positive lead, SOLAR PANEL+, of the solar panel 96 charges capacitor C4 through resistor R16. When capacitor C4 is charged to a certain voltage level, preferably approximately 1.2 volts higher than the battery voltage $B_+$, resistor R11 biases the capacitor C4 to discharge through the p-n-p transistor Q2 and into the positive terminal, BATTERY+, of the battery 90. As long as light reaches the solar panel 96, the battery charging process will be repeated and the solar panel 96 continually charges the capacitor C4 and battery 90.

In the second embodiment, the solar panel 96 only provides power to the control circuitry 98. Disposable, D-cell batteries or other disposable batteries can be used to power the motor 88, instead of the rechargeable battery 90. Because the control circuitry 98 is powered by the solar panel 96, the motor 88 will not operate unless there is light in the room, thus preventing the disposable batteries from becoming unnecessarily discharged. After the disposable battery has been fully discharged, the disposable battery can be replaced.

The control circuitry 98 also includes delay circuitry 112 to prevent the dispenser 10 from starting a new cycle of dispensing towel sheeting 50 until a predetermined time after the motor 88 has turned off from a prior dispensing cycle. The predetermined time is preferably approximately 2 seconds. The delay circuitry 122 includes a diode D2, resistor R3, and capacitor C1.

When voltage $V_{M2}$ is high, the motor 88 is running and causing towel sheeting 50 to be dispensed from the dispenser 10. When $V_{M2}$ is high, capacitor C1 is charge to a very high level, forcing reference voltage $V_B$ very high. It takes approximately 2 seconds for $V_B$ to return to its ambient light level setting. During that time, if a person places their hand in front of the photo sensor 82, voltage $V_A$ will not be forced higher than $V_B$. As a result, the motor 88 cannot be turned on again until approximately 2 seconds after it has been turned off. This prevents a continual discharge of towel sheeting 50 from the dispenser which could cause the battery 90 to discharge and the motor 88 to burn out.

Figure 6:
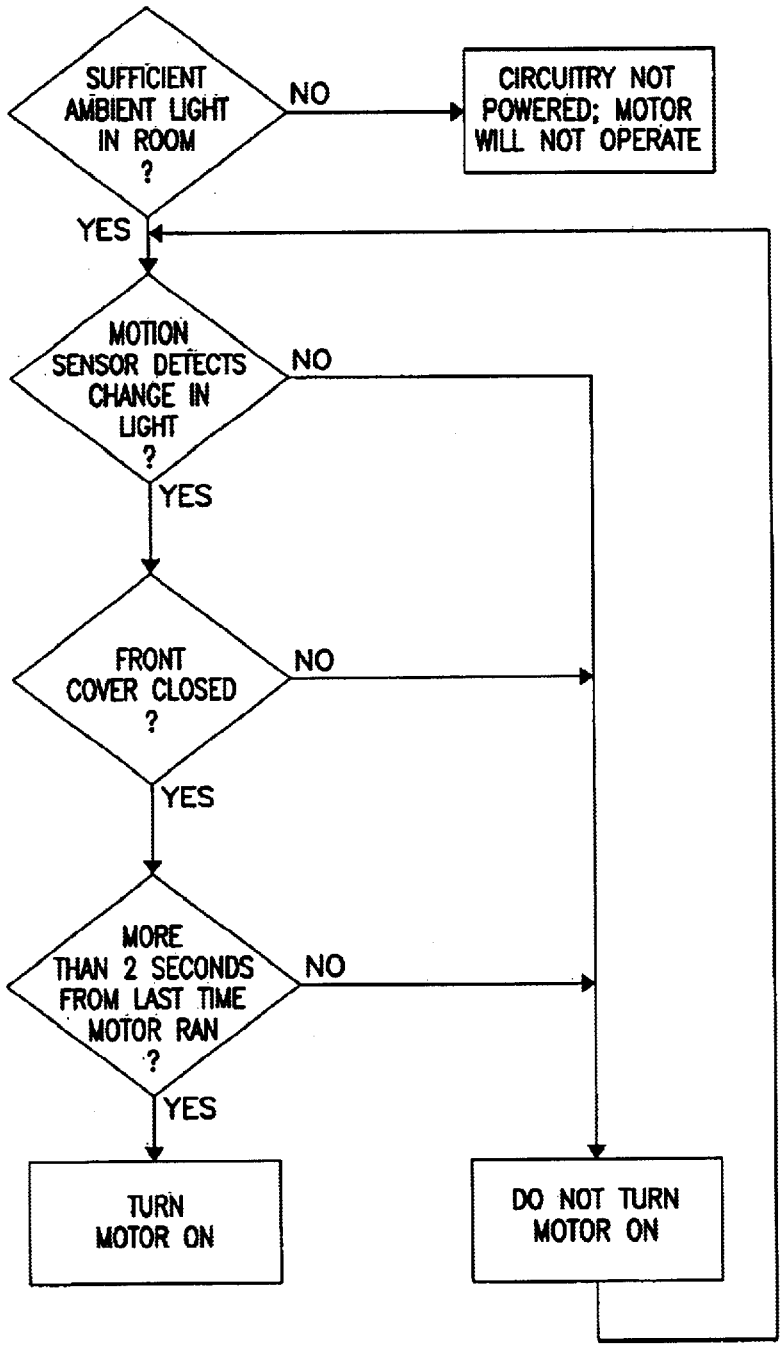
FIG. 6 is a block diagram describing operation of the hands free dispenser.
Figure 7:
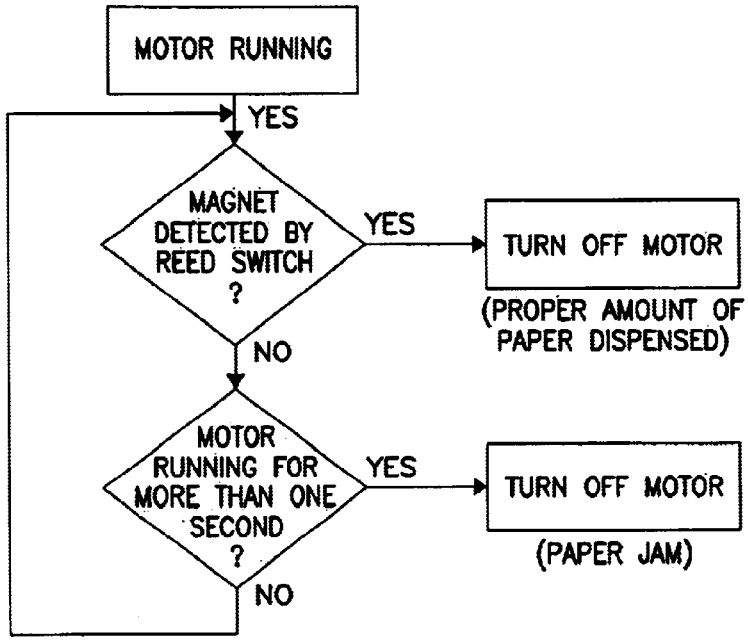
FIG. 7 is a block diagram describing operation of the safety shut off feature of the dispenser.

The manner in which the motor 88 is turned on is described in the flowchart of FIG. 6. The motor 88 cannot be turned on if there is not enough ambient light in the room to power the control circuitry 98. The solar panel 96 acts as an "on-off" switch for the dispenser 10 and will not permit the dispenser 10 to dispense towel sheeting 50 unless there is sufficient light in the room. If there is sufficient light in the room to power the control circuitry 98, the various checks, which have been described above with reference to the circuitry in FIG. 5, are shown in the flowchart of FIG. 6. These checks are performed before the motor 88 is turned on.

Figure 8:
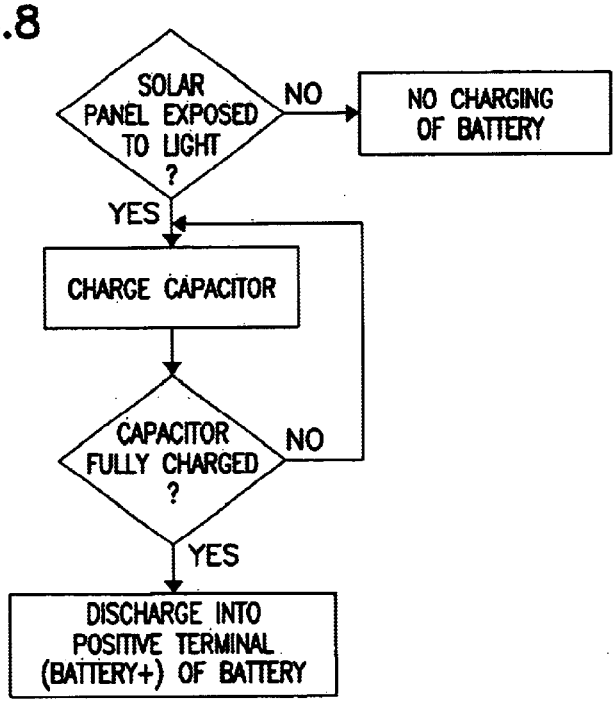
FIG. 8 is a block diagram describing how the battery is charged by the array of one or more photovoltaic cells.

The manner in which the motor 88 is turned off, which has been explained above with reference to FIG. 5, is described in the flowchart in FIG. 8. Similarly, the charging of the battery 90 by the solar panel 96, which has been explained above with reference to FIG. 5, is described in the flowchart of FIG. 8.

FIGS. 9–14 illustrate another embodiment of a hands-free towel dispenser 200 according to the principles of the invention. The dispenser 200 utilizes active infra-red (IR) sensing to trigger a dispense of paper toweling. The dispenser 200 also incorporates additional unique features that operate together with the active IR to provide an improved dispenser.

The use of active IR permits very short range sensing, such as within a range of about 5 inches to about 10 inches. It is important that the sensing distance not be too great, in order to prevent sensing of an individual or object from far away and thereby prevent an unintended dispense of paper toweling. The dispenser 200 of this embodiment floods a target area with IR light and then senses only that IR reflected by an object, such as a user's hand(s). The IR is emitted in short pulses at a predetermined frequency, which not only requires low energy, but prevents the dispenser from being activated by ambient lighting since the ambient lighting is unable to synchronize with the pulses and frequency of the IR light emitted by the dispenser.

Figure 9A:
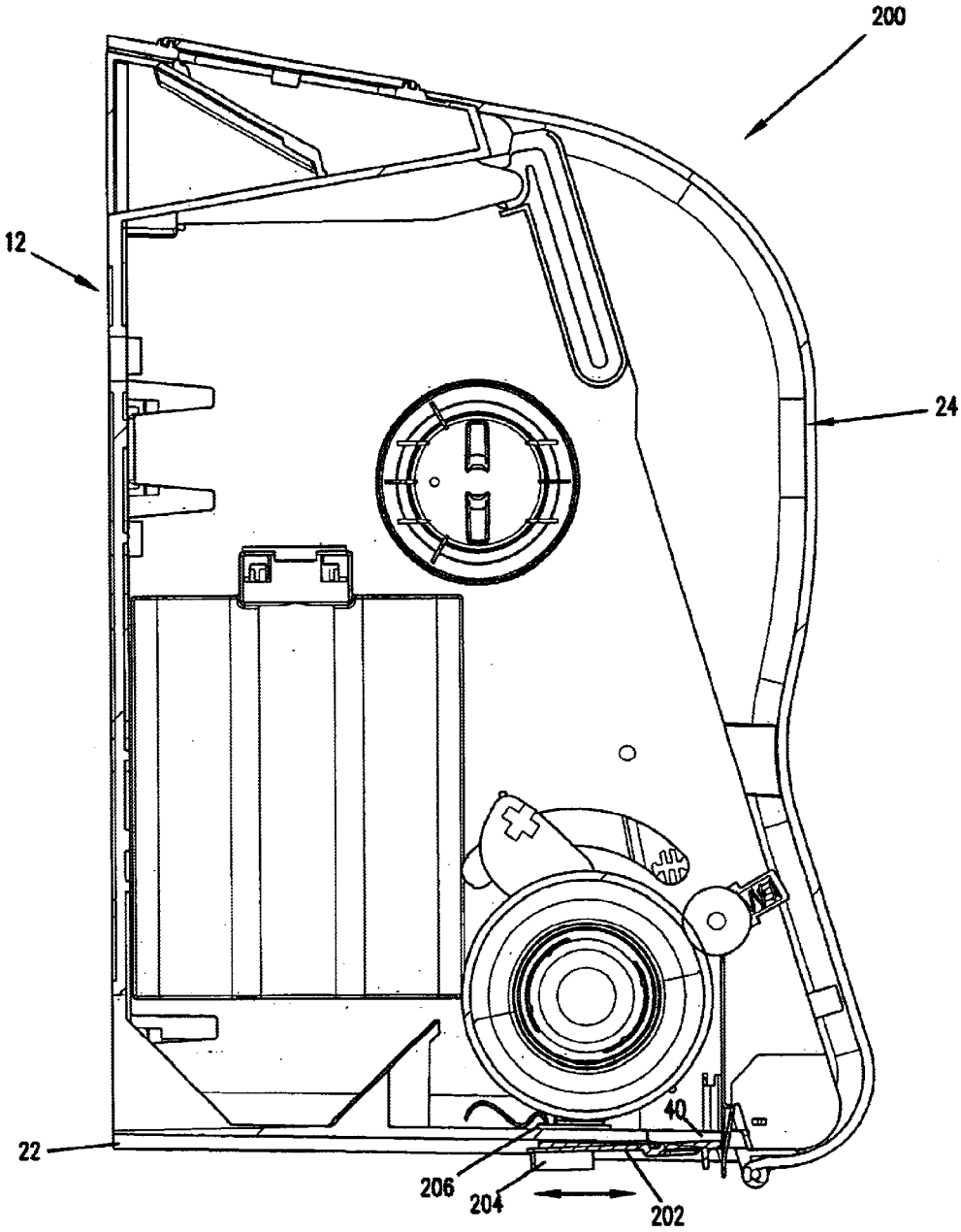
FIG. 9A is a sectional view of a side elevation of an alternative towel dispenser.
Figure 9B:
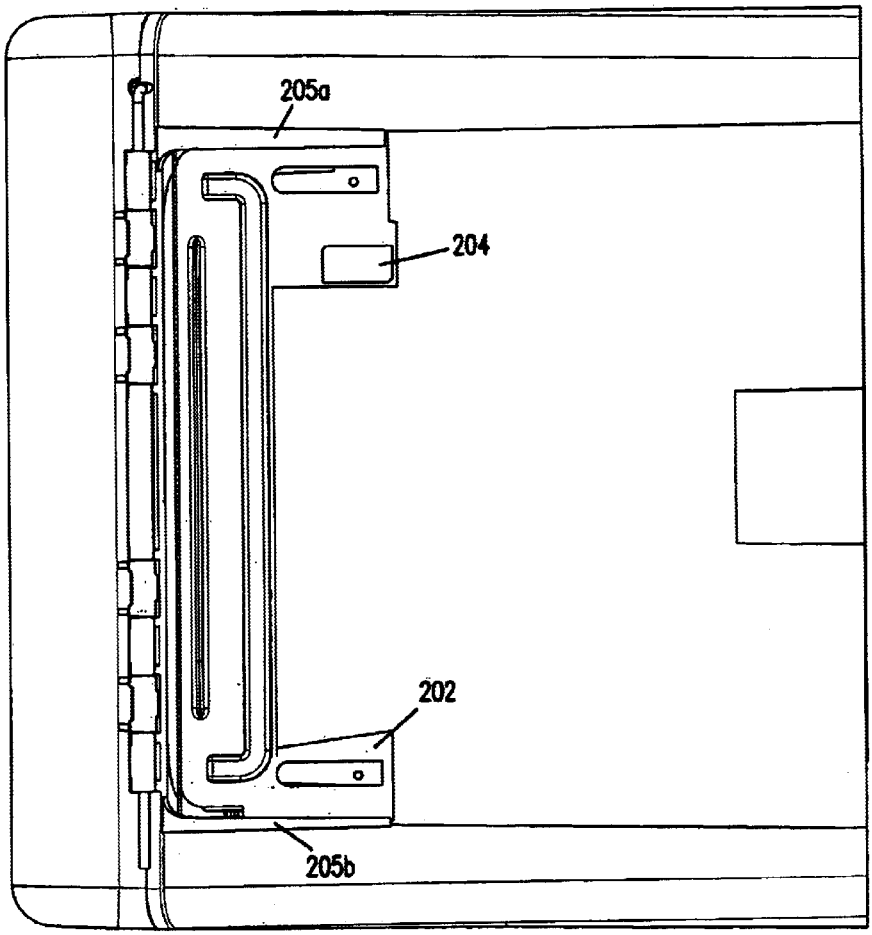
FIG. 9B is a bottom view of the alternative towel dispenser.
Figure 10:
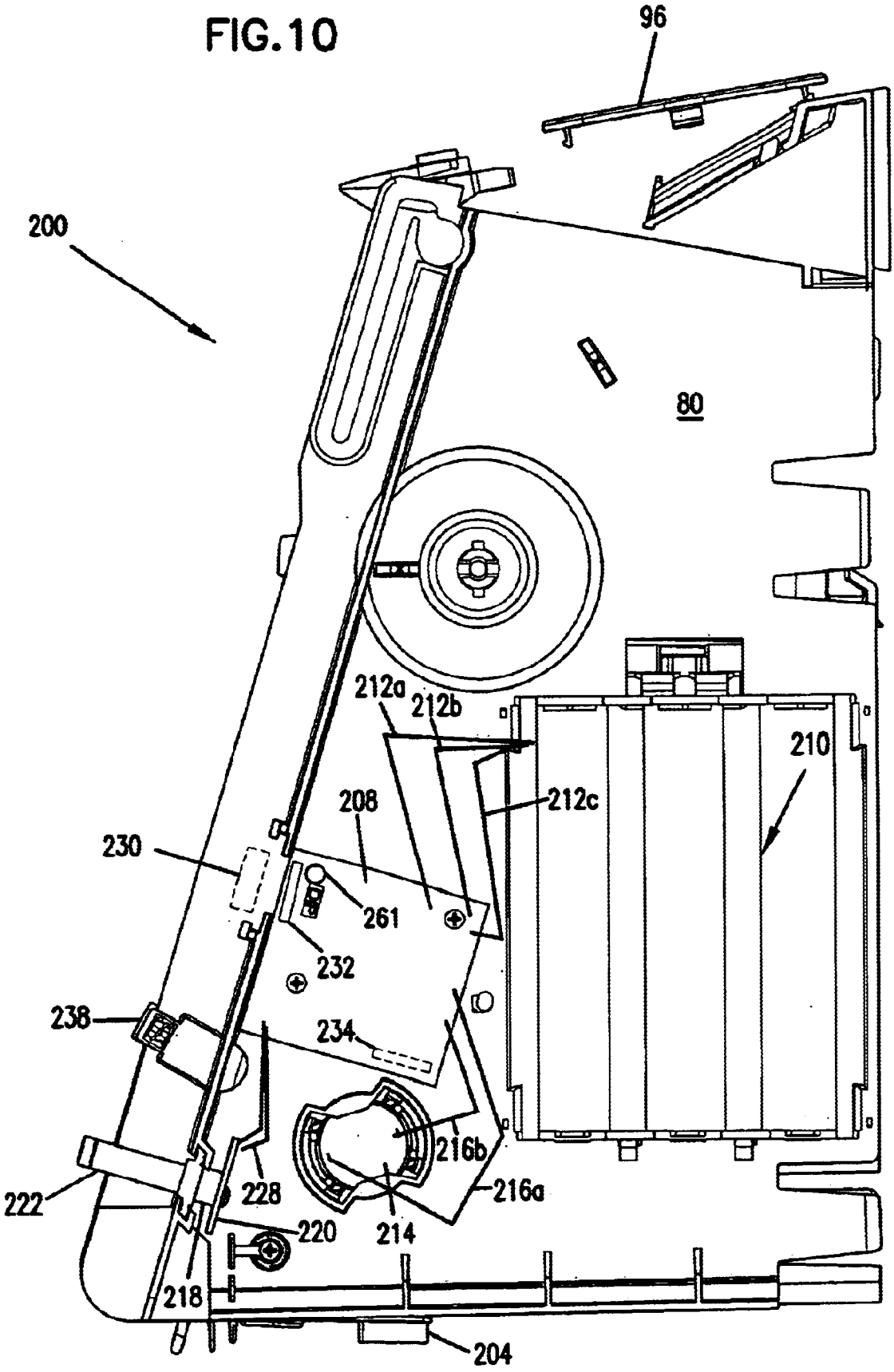
FIG. 10 is another sectional side elevation view of the alternative towel dispenser showing the location of the active sensing system and battery pack.

Turning to FIGS. 9 and 10, the dispenser 200 includes a cabinet 12 and front cover 24 as in the dispenser 10. Other elements in the dispenser 200 corresponding to similar elements in the dispenser 10 are referenced by the same numerals.

The dispenser 200 further includes a spray door 202 that is slideably mounted on the bottom wall 22 for sliding movement in the direction of the arrows in FIG. 9 between a first position, shown in FIG. 9, covering the slot 40, and a second position (not shown) to the left of the first position shown in FIG. 9 in which the slot 40 is uncovered. The door 202 is slideably supported at each end thereof in rails 205*a*, 205*b* formed on the bottom wall 22 whereby the door can be actuated manually between the first and second positions. The door 202 includes a magnet 204 thereon that interacts with a spray door switch 206 located on the cabinet 12.

The switch 206 is part of control circuitry (to be later described) for the dispenser 200. The magnet 204 and switch 206 function in such a manner that when the door 202 is in the position shown in FIG. 9 covering the slot 40, the switch 206 is closed and the dispenser 200 is prevented from operating. When the door 202 is slid backward to its second position with the slot uncovered, the switch 206 opens and permits operation of the dispenser 200. Thus, the door 202 permits the dispenser 200 to be cleaned without getting the paper towels wet and without the dispenser 200 dispensing towel.

Referring now to FIG. 10, the dispenser 200 includes a circuit board 208 that is mounted to the plate 80. As in the previous embodiment, the circuit board 208 is mounted between the plate 80 and the wall 16 of the cabinet 12. A battery pack 210 for powering the dispenser 200 is further provided and is coupled to the board 208 by leads or wires 212*a*, 212*b*, 212*c*. The battery pack 210 supplements the solar panel 96, and in low lighting conditions at which the solar panel 96 is ineffective, the battery pack 210 will totally support the electronics in the dispenser 200. Thus, the dispenser is able to function in all light conditions, including in the dark. A motor 214, similar to the motor 88, is also provided, and is coupled to the circuit board 208 via leads or wires 216*a*, 216*b*.

Figure 11:
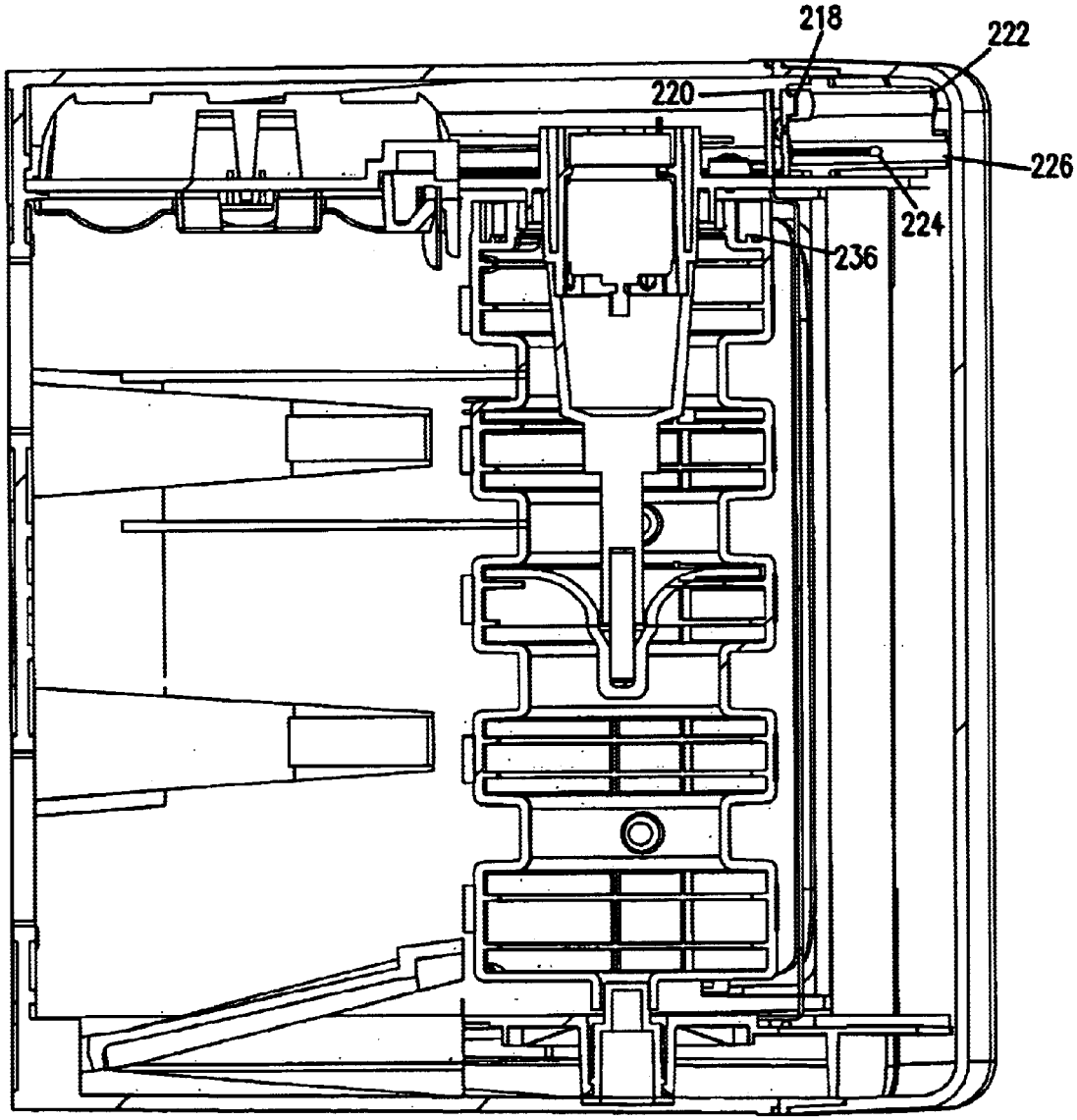
FIG. 11 is a sectional view looking down towards the bottom wall of the cabinet, showing the relative positions of the LED and IR sensor.

The dispenser 200 further includes an IR sensor 218 disposed on a sensor board 220. The IR sensor 218 is seated at the base of a sensor tube 222 which projects forwardly from the cabinet 12 so that the open end of the sensor tube 222 is disposed proximate the front cover 24. The front cover 24 is formed from a material that is transparent to IR thereby allowing IR light to pass through the cover. Since the cover 24 allows IR light to pass therethrough, a hole to permit passage of IR light need not be formed in the cover. In addition, as seen in FIG. 11, an LED 224 for emitting IR light is connected to the sensor board 220. The LED 224 is disposed within a tube 226 disposed next to the tube 222, with the tube 226 projecting forwardly so that the open end thereof is disposed adjacent the opening in the front cover whereby IR light is projected out from the dispenser 200. As shown in FIG. 10, the sensor board 220 is coupled to the circuit board 208 by a pair of leads or wires 228.

The IR sensor 218 and LED 224 form a portion of an active IR sensing circuit that is used to trigger a dispense of paper towels from the dispenser 200. The LED 224 emits IR light at a predetermined frequency. The light pulses will reflect off of a user's hand when the user's hand is sufficiently close and in proper position. The reflected light is picked up by the IR sensor 218 which causes the control system of the dispenser to dispense a predetermined length of paper towels.

FIG. 10 further illustrates the position of a magnet 230 (shown in dashed lines) that, like the magnet 121, is positioned in the front cover 24 for interaction with a reed switch 232. The switch 232 is activated by the magnet 230, with the switch being closed by the magnet when the front cover is closed. When the switch is closed, the dispenser 200 is able to dispense toweling when triggered by the IR sensing circuit. Otherwise, when the front cover is open, the switch 232 is open and the dispenser cannot dispense paper toweling. In addition, a reed switch 234 (shown in dashed lines) is provided which interacts with a magnet 236 (shown in FIG. 11) on the roller for sensing the revolutions of the roll. Moreover, FIG. 10 shows the location of a low battery LED 238 that is illuminated when a low battery condition exists in the battery pack 210 or when a paper jam occurs.

Figure 12:
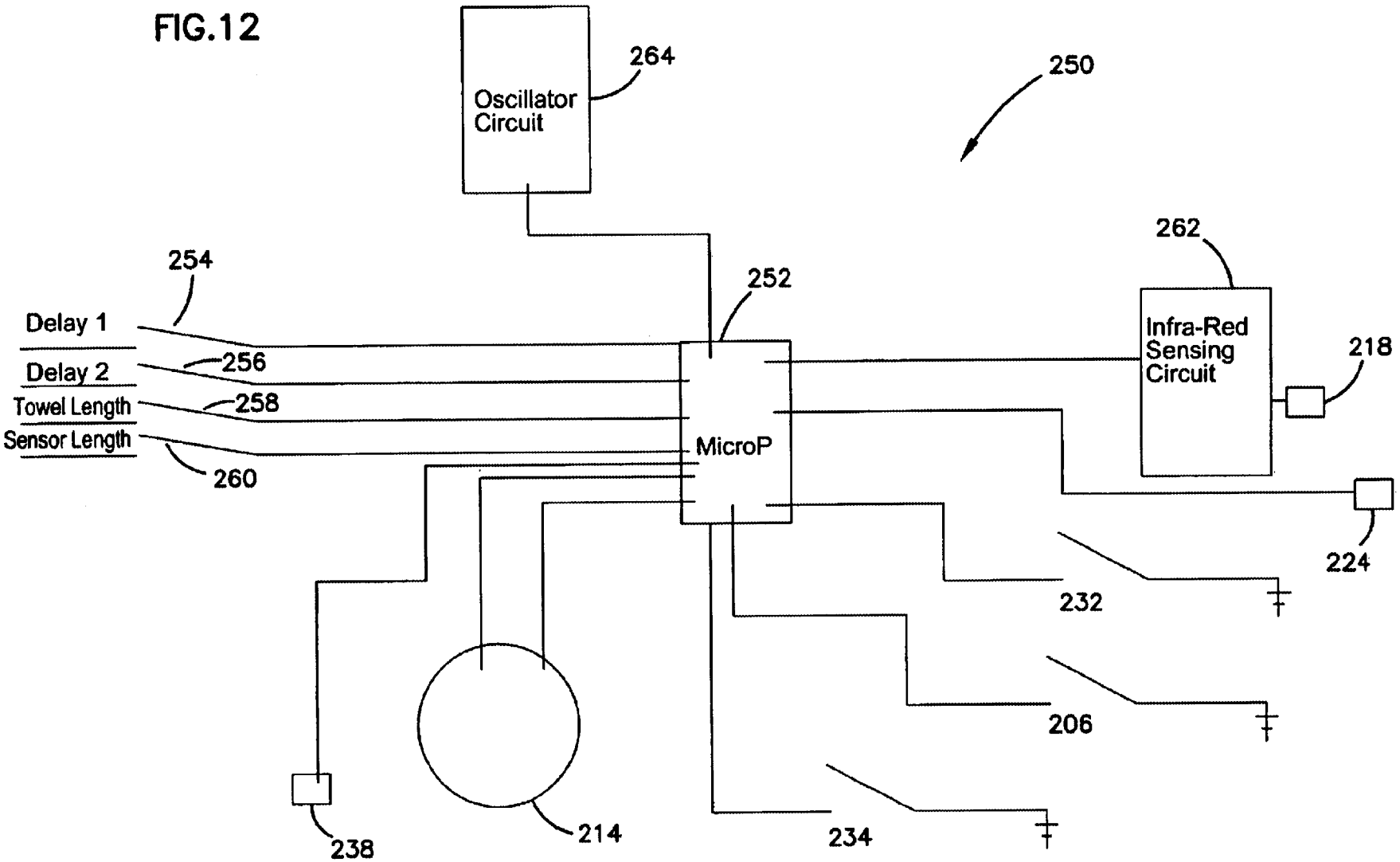
FIG. 12 is a schematic diagram of the control circuit for the dispenser in FIGS. 9 and 10.

FIG. 12 is a schematic illustration of the control circuitry 250 used to control the dispenser 200. A microprocessor 252 receives inputs from Delay I switch 254, Delay 2 switch 256, towel length switch 258, sensor length switch 260, IR sensing circuit 262, and the switches 206, 232, 234. The use of a microprocessor reduces costs and adds flexibility and functionality. The input from the Delay I switch 254 causes the microprocessor 252 to wait a predetermined length of time, such as 1 or 2 seconds, between accepting input from the IR sensing circuit 262. The input from the Delay 2 switch 256 is similar to the input from the Delay 1 switch, except that the predetermined length of time is greater, such as 3 seconds. Both Delay 1 and Delay 2 specify the amount of time that a user has to wait before a second dispense of paper toweling can occur.

The towel length switch 258 causes the microprocessor 252 to look for a predetermined number of activations, such as 1 or 2 activations, of the switch 234 to thereby control the length of the paper towel that is dispensed.

The sensor length switch 260 increases the power to the LED 224, thereby sending more IR light out of the LED. An increase in IR light makes detection by the sensing circuit 262 easier, and effectively increases the distance that the sensing circuit 262 can detect a user's hand or the like.

The length of toweling dispensed, the delay between cycles, and the LED power (i.e. sensitivity) can be changed by a dip switch 261 located on the circuit board 208.

The switch 206 associated with the spray door 202 must be open to permit operation of the dispenser 200. When the switch 206 is open, the spray door 202 is open, so that the slot 40 is uncovered and paper toweling can be dispensed therethrough. However, if the switch 206 is closed, a signal is sent to the microprocessor 252 which prevents the microprocessor from cycling the motor 214. Likewise, the switch 232 associated with the front cover 24 must be closed by the magnet 230 in order to permit operation of the dispenser. If the switch 232 is open, a signal is sent to the microprocessor 252 which prevents the microprocessor from cycling the motor 214

The switch 234 is designed to close when the magnet 236 in the roller passes nearby, which sends a signal letting the microprocessor 252 know that the roll has completed one rotation. When this signal is sent, the microprocessor 252 shuts the motor off 214. The switch 234 then opens waiting for the next activation by the IR sensing circuit 262.

In addition to receiving signals, the microprocessor sends out a signal to the motor 214 to control the operation thereof. The signal is sent to the motor 214 when the microprocessor 252 receives a signal from the IR sensing circuit 262, provided all necessary inputs, such as from the switches 262, 232 and the proper amount of delay has expired, are provided.

Further, the microprocessor 252 cycles the LED 224 at a predetermined frequency, preferably 7 Hz. The LED 224 emits IR light at that frequency, which reflect off of the user's hand for detection by the sensor 218. The IR sensing circuit 262 amplifies and/or filters the signal as necessary before sending the signal to the microprocessor. As indicated above, the sensor length switch 260 can be used to alter the power sent to the LED 224. The amount of power sent to the LED determines how close the user's hand needs to be to the IR sensor 218 in order to properly reflect light to the sensor 218.

Moreover, the microprocessor 252 will also count the signal inputs from the IR sensing circuit 262 and determine whether the time delay between signal inputs is roughly equivalent to the LED frequency. The microprocessor 252 preferably is designed to cycle the motor 214 only if two signals at the prescribed frequency have been received by the IR sensing circuit 262 and microprocessor 252.

Further still, the microprocessor 252 turns on the low battery LED 238 when a low battery condition of the battery pack 210 is indicated. A low battery condition is indicated by determining the cycle time between turning the motor 214 on and receiving input from the switch 234. If the cycle time is greater than a predetermined time, such a between 1–2 seconds, preferably 1.2 seconds, the low battery LED is illuminated, thereby providing an indication that the battery pack 210 needs replacement.

It is important that the dispenser 200 be designed to operate with low power and with high reliability, because the dispenser 200 has to be able to be in operational use for one or more years without intervention on the part of a user. Therefore, the control circuitry 250 further includes an oscillator circuit 264 that provides an input to the microprocessor 252. The oscillator circuit 264 is designed to turn the power to the microprocessor 252 on/off at a predetermined frequency thereby reducing the power consumption by the microprocessor. The preferred frequency is 7 Hz, although a higher or lower frequency could be used as well.

In addition to reducing power consumption, the oscillator circuit 264 resets the microprocessor logic so that if the microprocessor gets into a faulted state, the logic will be reset, thereby allowing the microprocessor to restart from a stored program, which is similar to rebooting a computer when the software stops functioning properly. This resetting operation happens at the oscillating frequency, such as 7 times per second, and thus the program can never stay in a faulty condition.

Figure 13A:
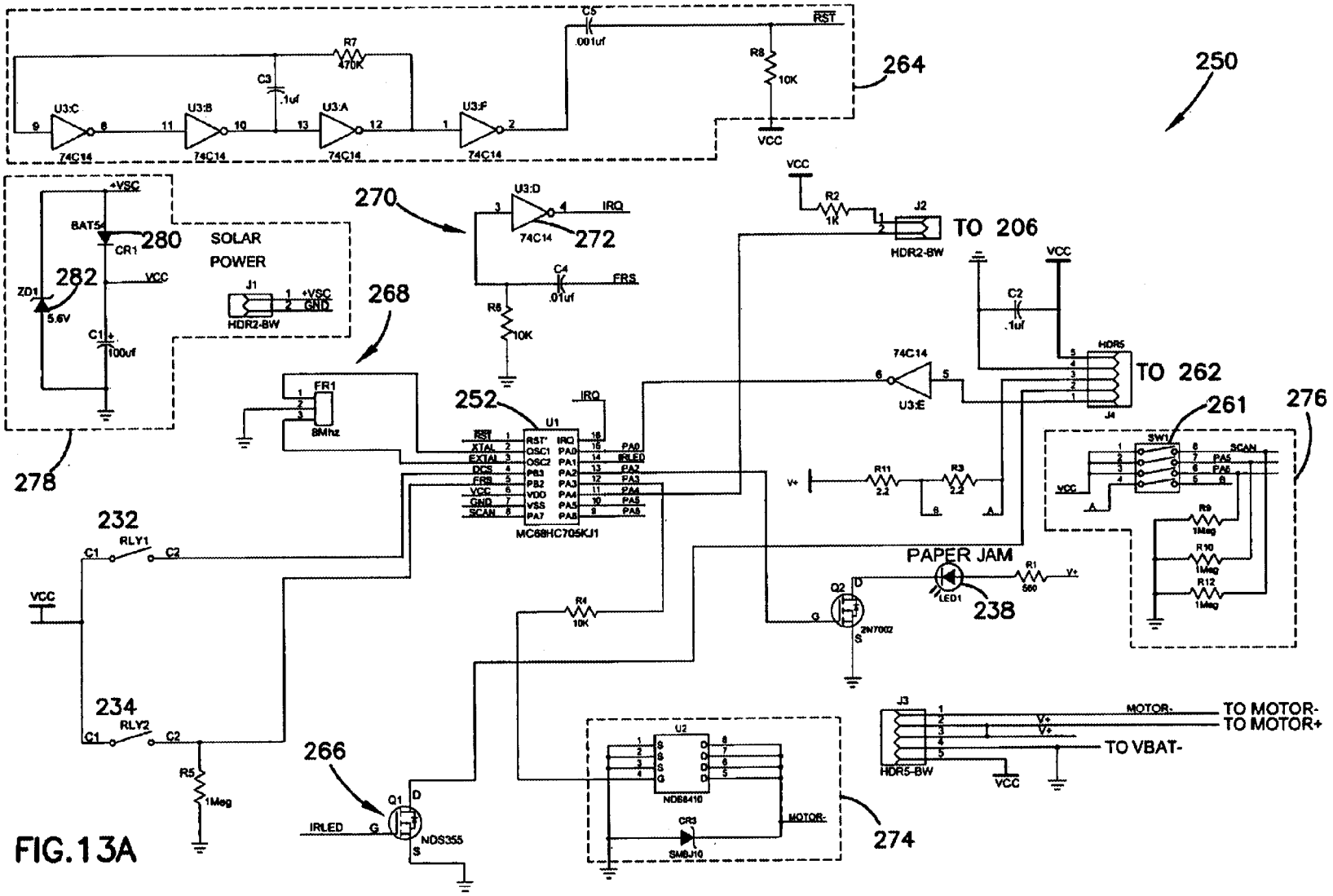
FIGS. 13A and 13B illustrate the electrical circuitry used with the dispenser of FIGS. 9 and 10.
Figure 13B:
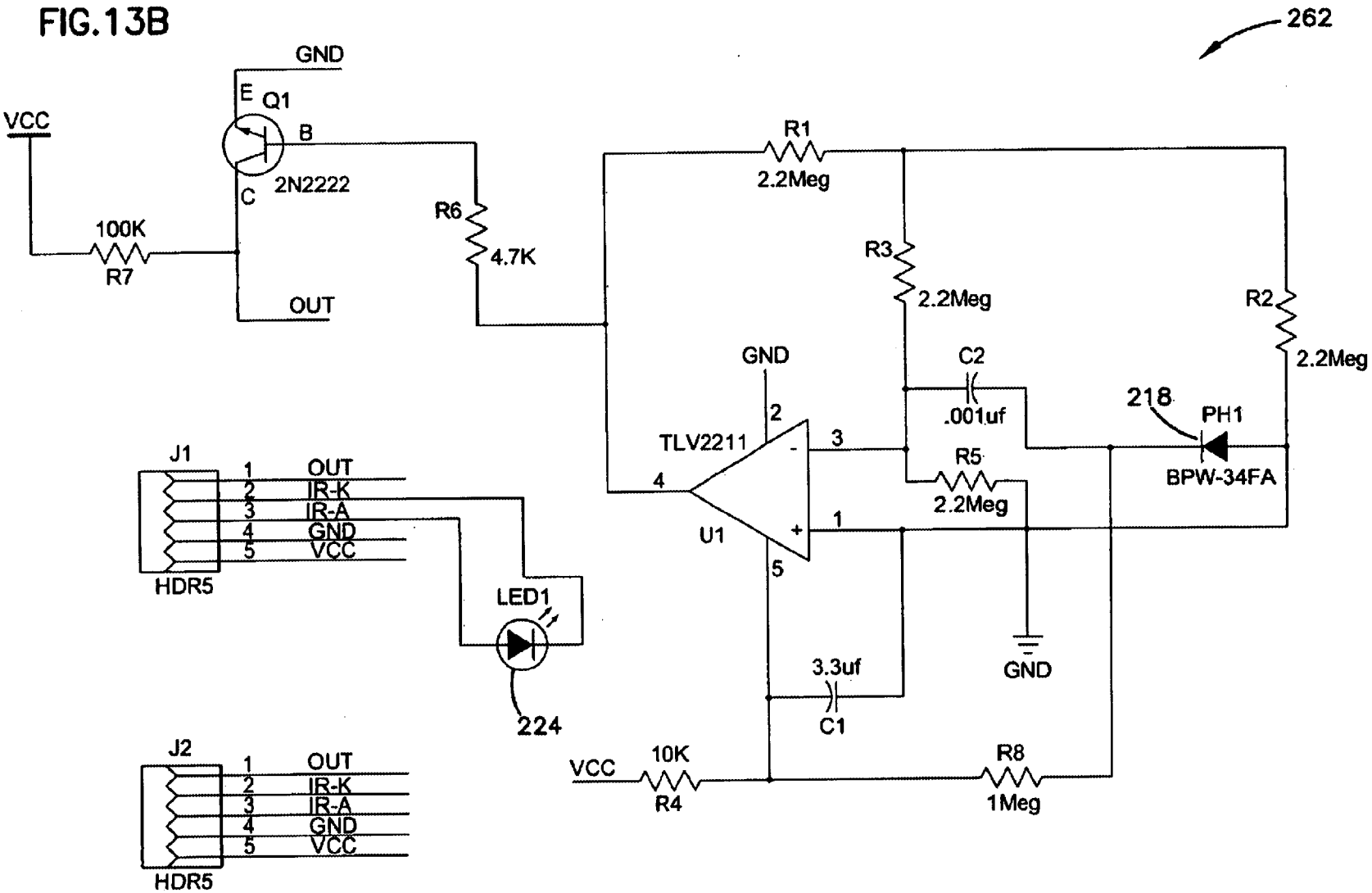

FIGS. 13A and 13B illustrate the details of the control circuitry 250, with FIG. 13A illustrating the circuitry on the circuit board 208 and FIG. 13B illustrating the details of the IR sensing circuit 262 on the sensor board 220.

In the sensing circuit 262, the LED 224 that provides the IR light is driven by a transistor driver 266 located on the board 208. The remainder of the circuitry in FIG. 13B is for amplifying and/or filtering the signal received by the IR sensor 218 which is preferably a photodiode.

As shown in FIG. 13A, the oscillator circuit 264 includes a plurality of Schmitt triggers that form a very low frequency oscillator so that the oscillator circuit 264 is able to oscillate all the way down to an applied voltage of about 1 volt. Therefore, as the battery pack dies down, the oscillator keeps running. The oscillator circuit 264 is preferably oscillated at a frequency of about 7 Hz so that it wakes up the microprocessor 252 seven times a second from being asleep and resets it. Further, the circuit 264 provides all the basic timing of the control circuitry 250 so the microprocessor 252 does not have to do any timing itself. Therefore, the microprocessor does not have to be awake to keep track of time, which means that it can go asleep and reduce power consumption radically. The circuit 264 is coupled to the reset of the microprocessor 252 on pin 1.

The control circuitry 250 further includes a processor clock 268. The clock 268 preferably operates at 8 MHz. This fast clock speed allows the microprocessor 252 to complete all of its functions as fast as possible, so that the microprocessor 252 can go back to sleep, via the oscillator circuit 264, as soon as possible. The result is that very little energy is consumed. Previously, processor clocks have been designed to operate slow so they consume less energy. However, the inventor's have discovered that running a processor clock, such as the clock 268, as fast as it can allows the microprocessor to return to its sleep state faster, thereby consuming less energy.

The control circuitry 250 further includes a circuit 270 that forces the microprocessor 252 to awaken when the roller is turning during a paper toweling dispense. The circuit 270 includes a lead FRS that is coupled to the switch 234 and receives a signal therefrom each time the magnet 236 on the roller turns past the switch 234. When the roller turns and the magnet 236 rotates past the switch 234, a signal is received over FRS and into a trigger 272 which generates a pulse that is sent via IRQ to wake-up the microprocessor 252 and shut the motor 214 off.

A motor control circuit 274 is also included for controlling operation of the motor 214.

An options control circuit 276 is further provided for controlling Delay 1, Delay 2, towel length and sensor length as described above with respect to FIG. 12. The dip switch 261 permits adjustment of these options.

The solar power control circuit 278 controls operation of the solar panel 96. The circuit 278 includes a diode 280 that prevents the power from the battery pack 210 from damaging the solar cells. The circuit 278 further includes a diode 282 that limits the voltage that is supplied by the solar panel 96. The inventors have discovered that in bright lighting conditions, the solar panel may produce too much voltage that could overpower the circuitry 250. The diode 282 limits the voltage supplied by the panel 96 and thereby prevents overpowering of the circuitry 250.

The LED 238 further acts as a paper jam indicator, in addition to the low battery indicator. As indicated above, a low battery state is determined by the cycle time of the roll that dispenses paper. Thus, timing how long it takes for the paper to come out provides an indication of how weak the battery pack 210 is. When it takes too much time, a low battery state is indicated and the LED flashes when the door 24 is opened. A paper jam condition is triggered when the magnet 236 in the roller is not sensed. If the magnet 236 does not return in about 2 seconds, the motor 214 will shutoff. After three consecutive "no magnet returns", the dispenser 200 will shut down to further sensor input, until the dispenser has been reset. The dispenser is reset by opening and closing the cover 24.

Thus, the dispenser 200 is able to work in all light conditions. Further, the dispenser consumes low power, so that batteries can be used to power the dispenser, with the dispenser being able to operate for long periods of time between servicing without frequent battery changes.

Figure 14:
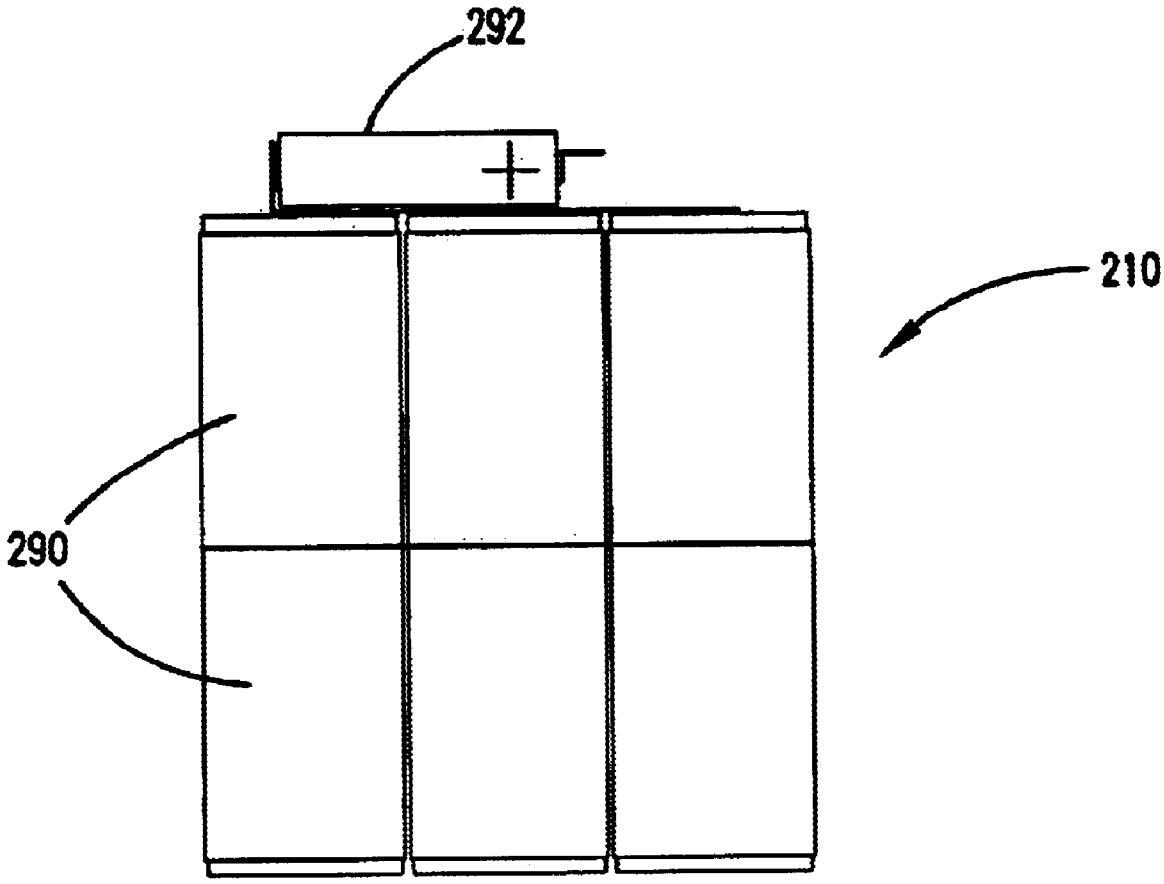
FIG. 14 illustrates the battery pack used with the dispenser of FIGS. 9 and 10.

The battery pack 210 is illustrated in detail in FIG. 14. The battery pack 210 includes a plurality of D cells 290, in this case six D cells, with an AA cell 292 disposed on top of the D cells and connected in series therewith. The D cells 290 are stacked two each in series to get 3V, with three stacks in parallel to obtain enough amperage. The A cell gets the voltage of the pack 210 up to 4.5V which is sufficient to operate the circuitry 250. Other battery pack configurations could be used instead of the pack 210, provided the battery pack provided sufficient voltage to operate the circuitry.

The embodiments of the inventions disclosed herein have been discussed for the purpose of familiarizing the reader with novel aspects of the invention. Although preferred embodiments have been shown and described, many changes, modifications, and substitutions may be made by one having skill in the art without necessarily departing from the spirit and scope of the invention.

We claim:

1. A hands-free towel dispenser comprising:

(a) a housing for containing at least one roll of toweling;

(b) a sensor for detecting an object;

(c) a dispensing mechanism for dispensing toweling when said sensor detects the object;

(d) at least one battery for powering said dispensing mechanism; and (e) control circuitry for controlling the dispensing mechanism, said control circuitry including a microprocessor and an oscillator circuit that turns power to the microprocessor on mad off at a predetermined frequency.

2. The hands-free towel dispenser according to claim 1, wherein said housing includes a dispensing slot, trough which toweling is dispensed, and a door mounted on the housing and moveable relative to the housing between a first position at which the door covers the dispensing slot and a second position at which the dispensing slot is not covered by the door.

3. The hands-free towel dispenser according to claim 2, wherein said control circuitry includes a switch that detects the position of said door, and wherein said control circuitry prevents operation of said dispensing mechanism when said door is at the first position.

4. The hands-free towel dispenser according to claim 1, wherein the control circuitry further includes an options control circuit that permits adjustment in the operation of the dispenser.

5. The hands-free towel dispenser according to claim 4, wherein said options control circuit includes means for adjusting the length of toweling dispensed.

6. The hands-free towel dispenser according to claim 4, wherein said options control circuit includes means for adjusting a delay between cycles of the dispensing mechanism.

7. The hands-free towel dispenser according to claim 4, wherein said options control circuit includes means for adjusting sensitivity of said sensor.

8. The hands-free towel dispenser according to claim 1, comprising a battery pack having a plurality of batteries.

9. The hands-free towel dispenser according to claim 8, further comprising an array of one or more photovoltaic cells.

10. The hands-free towel dispenser according to claim 1, wherein said sensor comprises an active infra-red sensing circuit.

11. The hands-free towel dispenser according to claim 10, wherein said active infra-red sensing circuit comprises a light emitting diode and an infra-red sensor.

12. The hands-free towel dispenser according to claim 1, wherein the predetermined frequency is 7 Hz.

* * * * *

UNITED STATES PATENT AND TRADEMARK OFFICE

CERTIFICATE OF CORRECTION

PATENT NO. : 6,695,246 B1
APPLICATION NO. : 09/538453
DATED : February 24, 2004
INVENTOR(S) : Elliott et al.

It is certified that error appears in the above-identified patent and that said Letters Patent is hereby corrected as shown below:

Col. 8, line 9: "witch" should read --switch--

Col. 10, line 58: "Delay I" should read --Delay 1--

Col. 10, line 62: "Delay I" should read --Delay 1--

Col. 10, line 62: begin new paragraph at "The input from the Delay…"

Col. 14, line 13, claim 1: "mad" should read --and--

Col. 14, line 16, claim 2: "slot, trough" should read --slot through--

Signed and Sealed this

Third Day of June, 2008

JON W. DUDAS
*Director of the United States Patent and Trademark Office*